United States Patent [19]

Haglund et al.

[11] 4,207,457

[45] Jun. 10, 1980

[54] PORCUPINE WIRE COIL ELECTRIC RESISTANCE FLUID HEATER

[75] Inventors: John H. Haglund, Danbury, Conn.; Robert G. Grandi, Park Ridge, Ill.

[73] Assignee: The Kanthal Corporation, Bethel, Conn.

[21] Appl. No.: 920,250

[22] Filed: Jun. 29, 1978

[51] Int. Cl.[2] ..... H05B 3/02

[52] U.S. Cl. ..... 219/381; 219/304; 219/307; 219/375; 219/546; 219/553; 338/302; 338/298; 338/333

[58] Field of Search ..... 219/369–371, 219/374–376, 379–386, 532, 538, 542, 546, 541, 307, 309; 338/315–321, 279–294, 57, 58, 322–325, 332, 267, 268, 304, 306, 296, 298, 299

[56] References Cited

U.S. PATENT DOCUMENTS

| | | | |
|---|---|---|---|
| 1,163,536 | 12/1915 | Henriksen | 219/307 |
| 1,171,059 | 2/1916 | Loguin | 338/304 |
| 1,401,657 | 12/1921 | Thornton, Jr. | 338/299 |
| 2,957,154 | 10/1960 | Strokes | 338/299 |
| 3,384,852 | 5/1968 | Beck et al. | 338/316 |
| 3,551,643 | 12/1970 | Pricewski | 219/381 |
| 3,786,162 | 1/1974 | Colson | 219/390 |

FOREIGN PATENT DOCUMENTS

| | | | |
|---|---|---|---|
| 223720 | 3/1962 | Austria | 338/299 |
| 1091249 | 10/1960 | Fed. Rep. of Germany | 219/307 |

*Primary Examiner*—B. A. Reynolds
*Assistant Examiner*—Bernard Roskoski
*Attorney, Agent, or Firm*—Kenyon & Kenyon

[57] ABSTRACT

A porcupine wire coil of electric resistance wire is positioned in a tube having an electrically insulating inside in which the peaks or looped ends of the coil convolutions are embedded so as to hold the coil convolutions spaced from each other. When the coil is energized, fluid flowed through the tube can be heated.

6 Claims, 11 Drawing Figures

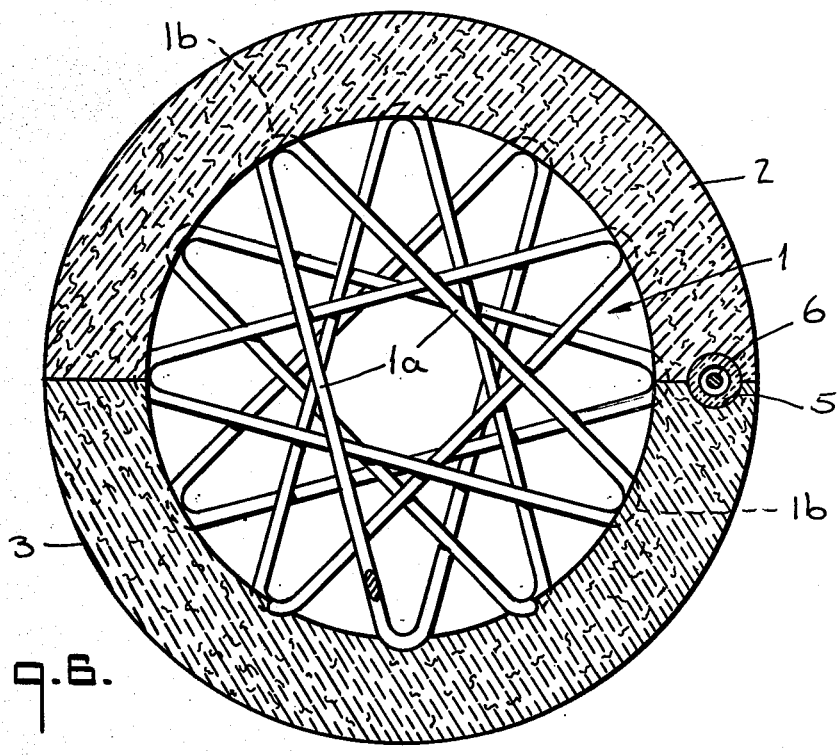
Fig. 6.
Fig. 11.
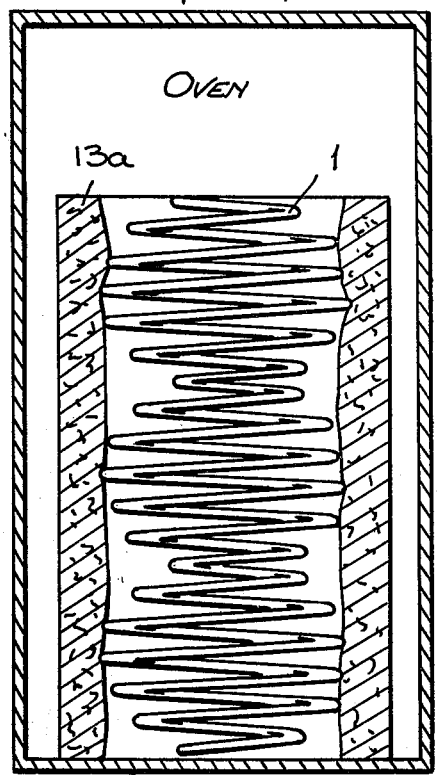
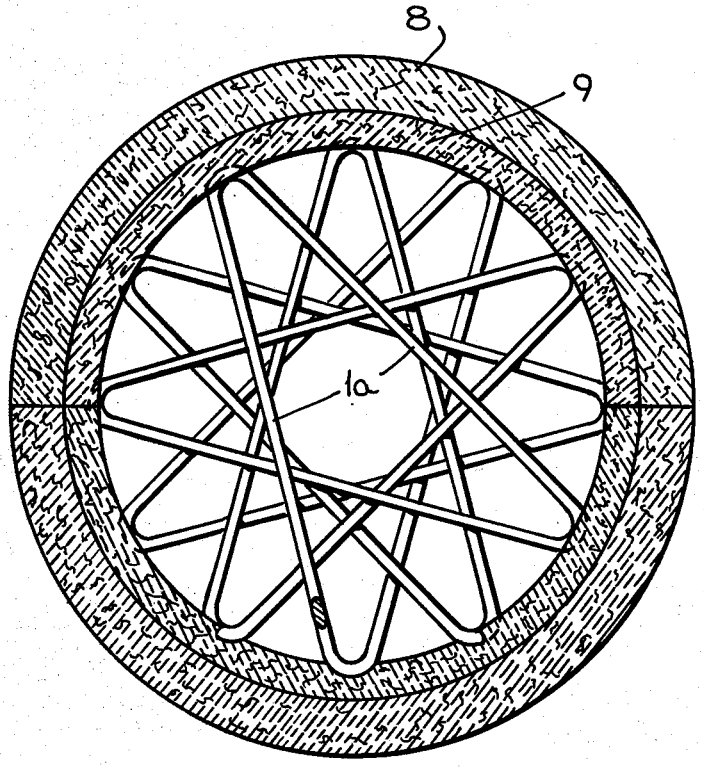
Fig. 7.

PORCUPINE WIRE COIL ELECTRIC RESISTANCE FLUID HEATER

BACKGROUND OF THE INVENTION

Because of its characteristic shape, the electric resistance wire coil configuration disclosed by the Loguin U.S. Pat. No. 1,171,059, Feb. 8, 1916, is today called a porcupine coil.

As disclosed by the Henriksen U.S. Pat. No. 1,163,536, Dec. 7, 1915, such a porcupine coil, when encased by a tube through which fluid can be flowed, potentially provides a high efficiency electric resistance fluid heater.

To make a porcupine coil, the electric resistance wire is wound on a flat mandrel so as to produce flat convolutions having looped ends which being of small radius can be called peaks. When released from the mandrel, the inherent spring-back of the wire causes the flat convolutions to partially rotate in the same directions so that the released coil automatically becomes a substantially helical series of substantially flat convolutions. These convolutions are bunched together throughout the length of the coil, requiring the coil to be stretched to separate the convolutions and prevent them from short-circuiting.

In the Henriksen patent the coil is held stretched by its ends being anchored to terminals, and in the Loguin patent the coil is suspended vertically by its top end, gravity apparently being relied on to hold the coil convolutions separated. Neither arrangement can provide a stable arrangement if the coil is subjected to high velocity fluid flow.

In the case of electric resistance wire cylindrically coiled with circular convolutions, it is old to hold the convolutions spaced apart by casting fluid or plasticized insulating material around the outside of the coil, which hardens to form a tube around the coil, in the inside of which the coil convolutions are partially embedded. This is exemplified by the Beebe U.S. Pat. No. 786,257, Apr. 4, 1905. This expedient permits only about half of the wire surface area to be exposed to fluid flow through the tube.

SUMMARY OF THE INVENTION

According to the present invention, a porcupine coil of electric resistance wire characteristically formed by a substantially helical series of substantially flat convolutions having looped ends or peaks, is stretched in its axial direction so that the convolutions are spaced from each other at least enough to prevent short-circuiting between the convolutions. Then a tube having an electrically insulating inside at least, is formed so as to enclose the coil with only the peaks of its convolutions embedded in the tube's inside. The degree of embedding need be only sufficient to anchor each convolution against movement individually, leaving the balance of each convolution entirely exposed inside of the tube so that a high heat exchange efficiency can be obtained when fluid is flowed through the tube. The fluid must flow through the crisscrossing maze of the flat convolution legs so as to produce turbulent flow conditions preventing free by-passing flow through the inherently open coil center which is preferably left completely open. With each of the coil convolutions individually anchored via their peaks, a high velocity flow through the tube containing the coil cannot displace the arrangement of the initially stretched porcupine coil inside of the tube.

To make the new heater, it is at present preferred to use a tube made from felted ceramic fibers providing for structural rigidity while being deformable or compressible under pressure applied at any localized area. Products of this kind are commercially available and are both electrically non-conductive and refractory. The inside diameter of the tube should be slightly smaller than the outside diameter of the stretched porcupine coil, and then for example by longitudinally splitting the tube into two halves, the tube can be assembled around the stretched porcupine coil and the two halves pressed forcibly together, the looped ends or peaks of the coil convolutions compressing the fibrous material locally and indenting the tube's inside so as to at least partially embed the peaks in the inside of the assembled tube. With the two halves joined as by being cemented together or externally banded or encased, each convolution of the coil is individually locked in position and held, permitting the stretching tension in the coil to be released. If the coil is made with each flat convolution having the same length, each convolution is embedded to the same extent and individually locked in position lengthwise with respect to the tube. Because the convolutions have straight legs running between their looped ends, they can resist a relatively high degree of radial pressure without the convolutions becoming materially deformed.

The necessary electrical connections to the ends of the coil in the tube may be made in any fashion desired. The tube may be internally slightly tapered, the coil peaks indenting the inside for increasing depths through the tube length. For multi-phase AC powering, the coil may be divided into two or more sections to accommodate the different phase connections then required. The coil and tube may be of any length or diameter desired, coil diameters ranging up to six inched being contemplated at the present time. The electric resistance wire diameter or gauge should be appropriate for the current loading contemplated, and the wire composition may be any of those considered suitable for electric resistance heating purposes.

If a heater having greater structural rigidity is desired, the two halves may be made of a rigid hard ceramic material having the characteristics of porcelain, for example, with its inside lined by a layer of the molded ceramic fibers. It is also possible to line the two rigid sections or halves with an enamel slurry of adequately high viscosity which can be subsequently fired so that the entire tube structure becomes rigid. Alternately, the tube can be unsplit or integral circumferentially, and internally coated with the enamel slurry, the coil being then inserted and while held stretched, and the enamel hardened to anchor the peaks and permit the stretching force to be released.

It is also possible to vacuum form the ceramic fiber tube integrally around the porcupine coil by first encasing the coil held stretched by a suitable fixture, in a porous woven fabric bag so that by immersion in a slurry of the ceramic fibers with suction applied to the inside of the bag, the slurry molds itself against the convolution peaks while the bag prevents penetration of the fibers into the coil's interior while the slurry's liquid component is sucked through the bag. Hardening of the molded tube then produces the heater with the coil convolutions anchored as described before, but now encased by an integral tube of ceramic fibers.

BRIEF DESCRIPTION OF THE DRAWINGS

The accompanying drawings illustrate the principles of this invention, the various figures being as follows:

FIG. 6 is an end view of the completed heater showing how the convolution legs crisscross to form a maze through which the fluid must flow;

FIG. 7 is like FIG. 6 but provides an example of the use of a rigid tube lined with the molded ceramic fibers or possibly with an enamel;

FIG. 11 shows the coil with its molded tube of FIG. 10 being heated for drying or hardening.

DETAILED DESCRIPTION OF THE INVENTION

Figure 4:
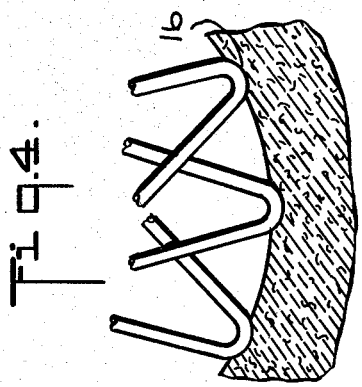
FIG. 4 is like FIG. 3 but shows that by the application of pressure the peaked or looped convolution ends are pressed into the inside of the tube to compress the fibrous material when the two halves are pressed together.
Figure 3:
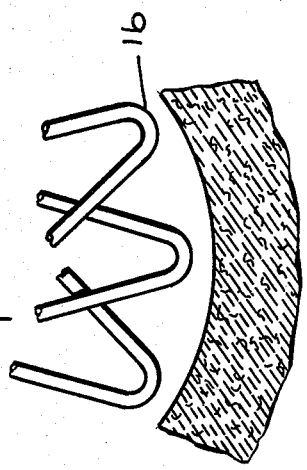
FIG. 3 is a cross section of a segment of FIG. 2 showing one of the tube halves approaching the peaks or looped ends of the porcupine coil convolutions.
Figure 1:
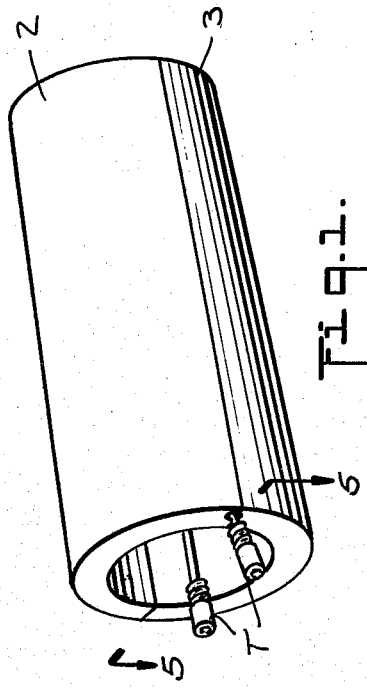
FIG. 1 in perspective shows the new heater when the longitudinally split tube of molded ceramic fibers is involved.

In the above described drawings, FIG. 1 shows the external appearance of the new heater with the understanding that for most applications it would be substantially longer relative to its diameter than is indicated in that view.

Figure 2:
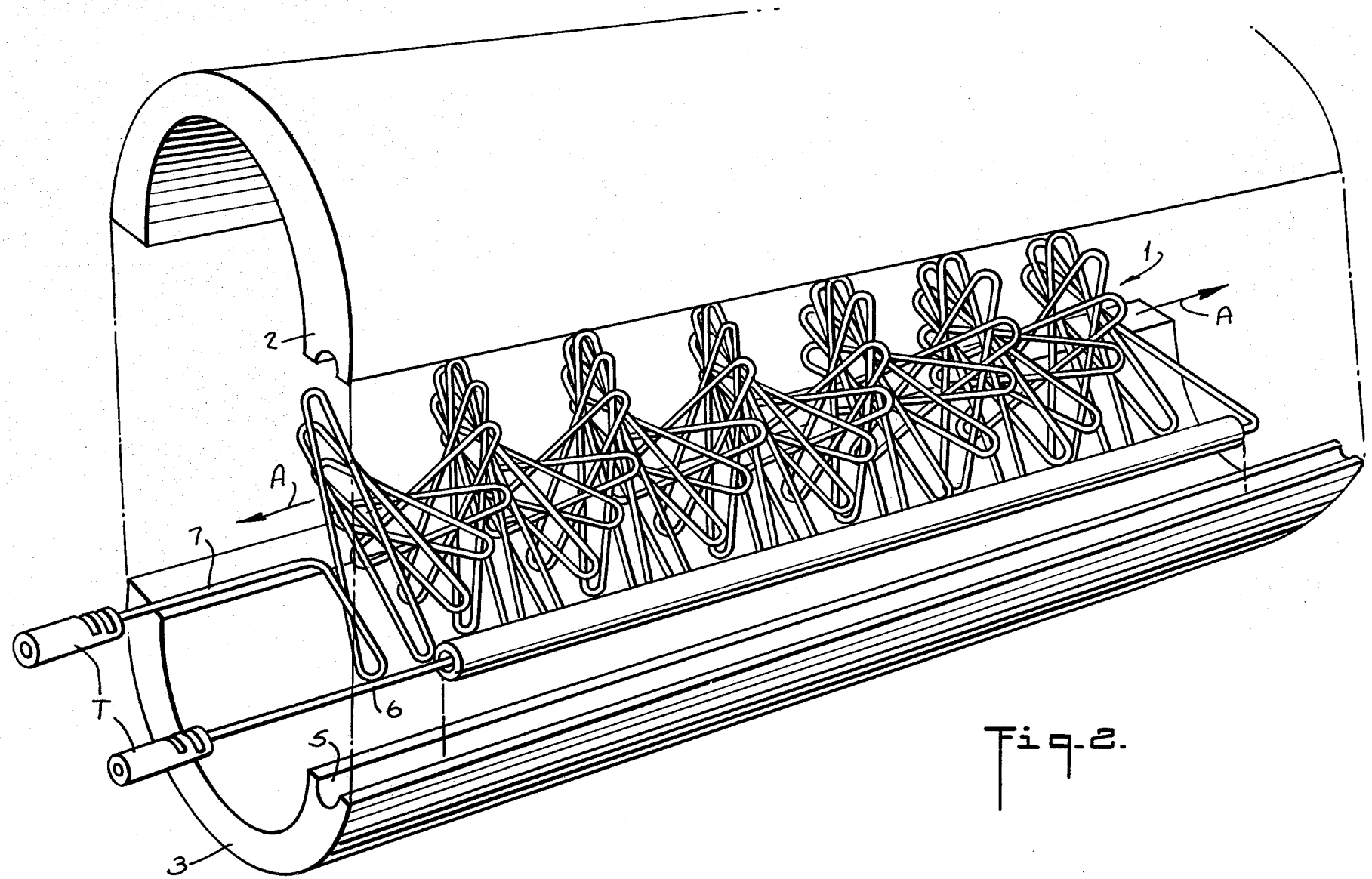
FIG. 2 in perspective shows the porcupine coil stretched apart as illustrated by the arrows, along with an example of one form of electrical connection arrangement and the two tube halves of molded ceramic fibers about to be pressed together.

FIG. 2 shows the internal construction, the porcupine coil 1 being positioned between the two semicylindrical halves 2 and 3 made of molded ceramic fibers. As previously indicated, tubes made of molded ceramic fibers are commercially available and can be bought and longitudinally slit to provide the two halves. The ceramic fibers are felted together or molded so that such a tube is rigid and has substantial mechanical strength while at the same time being deformable under localized pressure. The ceramic fiber material is both electrically non-conductive or insulating and it is adequately refractory for high temperature use.

In FIG. 2 semicylindrical channels 4 and 5 are shown formed in the edges of the two halves for receiving a conductor 6 extending backwardly from the front end of the coil, the back end of the coil having the necessary second conductor 7 directly connected at that end, both conductors being provided with terminals T. The characteristic shape of the porcupine coil convolutions can be appreciated by looking at FIG. 6 showing an end view of the completed heater resulting from the two halves 2 and 3 being pressed together with their edges abutting and either cemented together or with the two halves mechanically held together by an unillustrated banding or insertion in a rigid tube holding the two parts together.

Also, in FIG. 6, it can be seen how the coil convolutions have straight legs 1*a* and looped or peaked ends 1*b*, and how each convolution is rotatively oriented with respect to the next adjacent convolution. When stretched as indicated by the arrows A in FIG. 2, the convolutions separate from each other. The appearance of the coil as shown by FIG. 2, explains why such a coil has become known as a porcupine coil.

The peaks 1*b* of the convolutions provide for what is substantially a point pressure in each instance, so that radial pressure closing together the two halves shown by FIG. 2, results in the peaks 1*b* indenting or penetrating and partially embedding into the ceramic fiber material by localized compression of the material. When this is performed with the coil stretched enough to keep the convolutions separated from each other, or to any greater degree desired, after the two halves are closed together and held, each coil convolution is locked individually against displacement and, at that time, the tension applied to stretch the coil, indicated by the arrows A as previously mentioned, can be released. Each coil convolution is solidly locked in place and firmly held against displacement even though fluid to be heated is flowed at high velocity through the resulting tube.

It is to be understood that the internal diameter of the tube formed by the two halves 2 and 3, should be slightly smaller than the external diameter of the porcupine coil, the extent of difference being represented by the desired extent of the penetration of the loop ends or peaks 1*b* into the ceramic fiber material.

Figure 5:
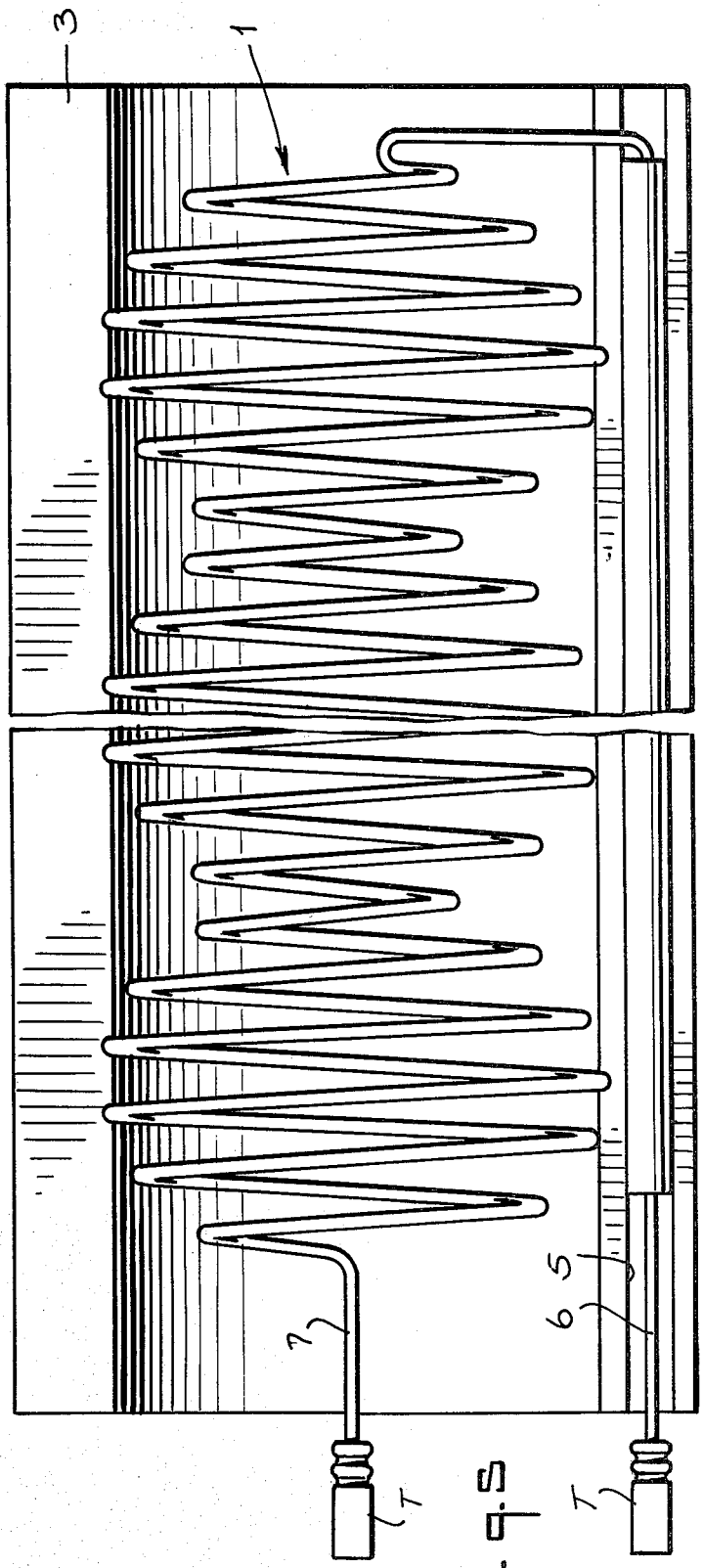
FIG. 5 is a longitudinal section through the completed heater.

It should be apparent that in FIG. 5 the points of penetration can be shown only where they occur in the case of convolutions oriented in the plane represented by the section shown, but that all of the other convolutions shown are equally firmly anchored in the same way .

The manner in which the coil is held stretched during closing of the two halves represented by the tension-indicating arrows A, is not shown, Academically this should be done manually; under commercial production techniques suitable fixtures are used.

As previously indicated, a rigid external tube or shell 8 can be used as indicated by FIG. 7, this part being too rigid or hard for the convolution peaks to penetrate, but being lined as shown at 9 with refractory material providing this characteristic. Both of the tubular parts 8 and 9 may be split as described before, only the inner part 9 may be split with the outer tube 8 circumferentially solid and slid over the parts 9 after they are put together, or the tube 8 can be unsplit and the part 9 then be a layer of ceramic slurry, or unfired enamel, into which the coil convolution looped ends or peaks can very easily penetrate after the coil is inserted and stretched in the tube, subsequent drying or firing, possibly by powering the coil itself, hardening the layer 9.

Incidentally, the characteristic fully open coil center is well illustrated by both FIGS. 6 and 7 where the crisscross convolution legs can be seen. The small portions of the electric resistance wire partially embedded in the surrounding tube structure do not detract to any appreciable degree from the heating efficiency obtainable. Fluid flow through the annular maze of criss-crossed wires produces so much turbulence that free or bypassing flow through the open coil center is made a practical impossibility or at least inappreciable, because the turbulence exists there as elsewhere.

As in the manufacture of paper, the ceramic material referred to can be made from a slurry of ceramic fibers from which the liquid component is removed to produce a solid material. Therefore, the new heater can be made by making the ceramic fiber tube on the coil.

Figure 8:
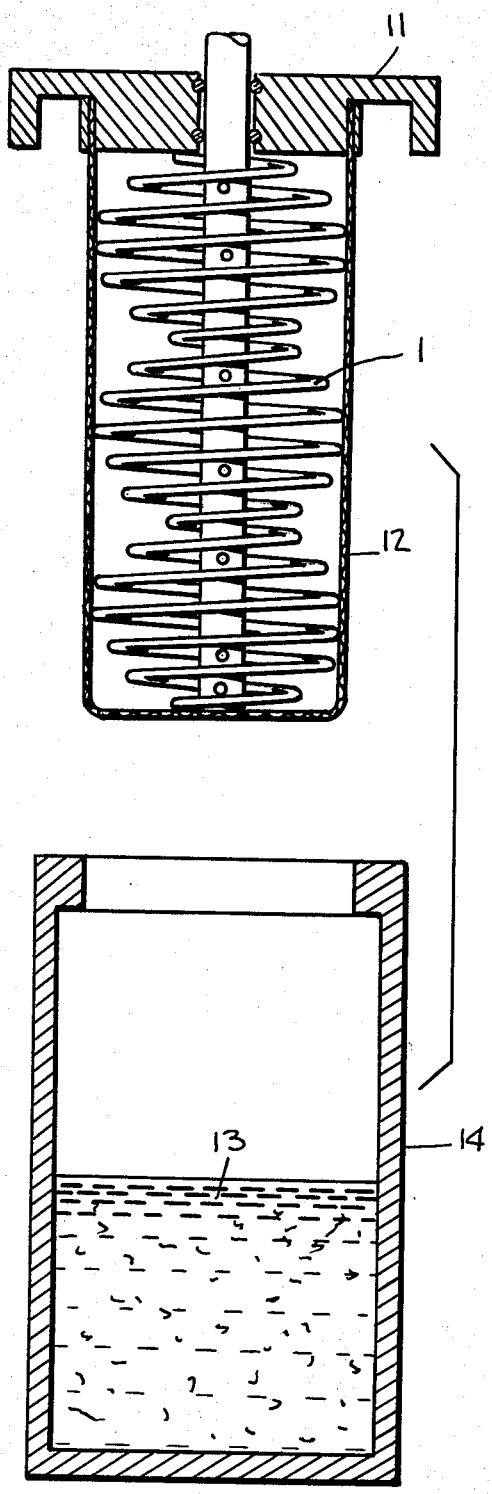
FIG. 8 in vertical section shows the stretched porcupine coil encased in the porous bag and about to be inserted in a mold holding a slurry of ceramic fibers.

The above is illustrated by FIGS. 8 through 11. In FIG. 8 the coil 1 is shown as being stretched by a tubular fixture 10 having a perforated wall and depending from a cap 11 and with the coil encased by a bag 12 which may just touch the convolution loop ends or peaks. The bag should be porous and may have the characteristics of nylon hosiery, a nylon hose having in fact been used when experimentally practicing the procedure under description. In FIG. 8 the assembly is about to be immersed in a slurry of ceramic fibers 13 in a container 14 to the top of which the cap 11 can be applied air-tightly, the depth of the container 14 being at least as great as the length of the stretched coil and its porous enclosure 12.

Figure 9:
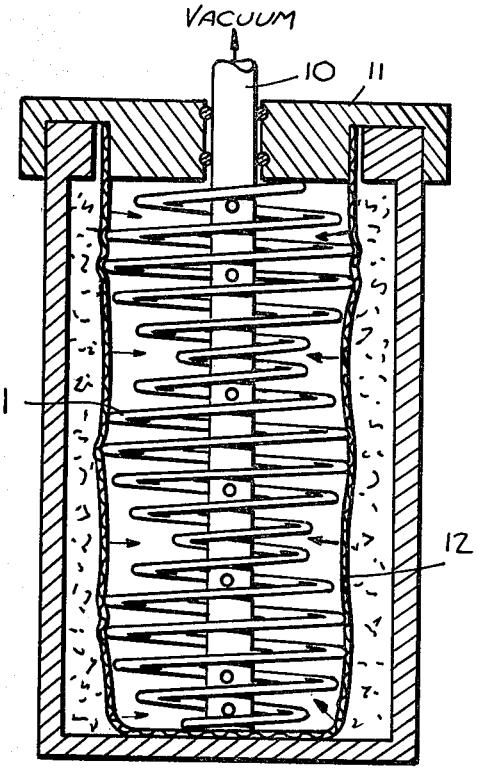
FIG. 9 is the same kind of view but shows the coil and bag immersed in the slurry and an internal vacuum being drawn.
Figure 10:
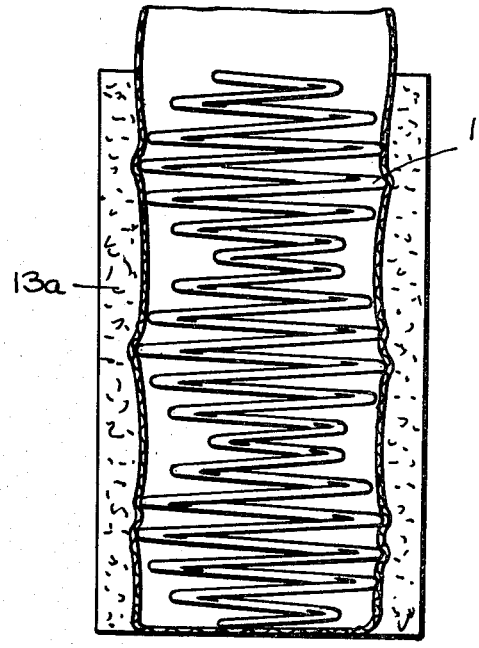
FIG. 10 is like FIG. 9 but shows how the slurry by suction withdrawal of its liquid component has molded against the peaks or looped ends of the porcupine coil convolutions while forming a tube.

FIG. 9 shows how by suction applied via its top end, the tubular fixture 10, which has the perforated wall, is used to draw a vacuum inside of the bag 12 when the cap 11 is applied to the container 14, the slurry 13 being displaced upwardly by immersion of the parts to completely fill the space between the outside of the bag and the inside of the container. As the space inside of the bag is evacuated, the liquid component of the slurry 13 is drawn inwardly and carried away, the ceramic fiber component compacting on the outside of the bag. Although called a slurry, it is to be understood that the material 13 may have a high concentration of ceramic fibers relative to the liquid component so that the inside of the container 14, which is cylindrical, can provide what is, in effect, a mold so that after the liquid component, which can be water, is abstracted, the coil is surrounded by the ceramic fiber tube that is integral and inherently molded against the loop ends or peaks of the porcupine coil convolutions as indicated by FIG. 10.

In the above condition the molded casing or tube is still moist. As shown by FIG. 11, this green form or assembly can be positioned in a drying enclosure or oven to remove all residual moisture and produce a rigid and adequately strong construction. The green and finally hardened tube is numeraled **13*a* in FIGS. 10 and 11**.

It is appropriate to note that if a plain helical coil has its convolutions positioned in the same manner as described hereinabove, that a very substantial heat-transfer efficiency loss results because throughout the length of the coil substantially half of the wire cross section is lost insofar as transfer of heat from the wire to fluid flowing through the coil is concerned.

The principles of the present invention are particularly applicable to heat guns. Such a device must be tubular, provide for a large flow rate of fluid moving a high velocity, and be capable of bringing the flow, which is usually an air flow, to high temperatures, one example of such a gun being provided by the Pricenski et al U.S. Pat. No. 3,551,643, Dec. 29, 1970. For this kind of application the present invention provides the advantage that each coil convolution is rigidly held at its opposite ends or peaks with the straight convolution legs forming beams or bridges between the supported ends. The ratio between the wire surface that is freely exposed and that which is embedded in the surrounding tube, is very great, resulting in the heat transfer efficiency being maximized.

What is claimed is:

1. A porcupine wire coil electric resistance fluid heater comprising a porcupine coil of electric resistance wire formed by a substantially helical series of substantially flat convolutions having straight legs and looped ends, the wire having an inherent spring-back biasing the convolutions to bunch together and the coil being stretched in its axial direction so that the convolutions are spaced from each other, and a tube having a substantially cylindrical inside adapted to conduct a fluid flow and formed by refractory electrical insulation and enclosing the stretched coil, each of the said looped ends being embedded in said insulation with a degree of embedding sufficient to individually anchor immovably each of the coil's convolutions while leaving said straight legs of each convolution exposed to said fluid flow.

2. The heater of claim 1 in which said tube is made of molded ceramic fibers and has an inside diameter smaller than the outside diameter of said coil and said looped ends compress said fibers on the tube's said inside so that the looped ends are at least partially embedded in said inside by indentation of the latter.

3. The heater of claim 1 in which said tube is a hard ceramic tube lined with a hard vitreous enamel forming said inside in which said looped ends are partially embedded.

4. The heater of claim 1 in which said tube is made of ceramic fibers molded on said coil with said fibers molded around said loop ends.

5. The heater of claim 2 in which said tube is longitudinally split into sections which are interjoined.

6. A fluid heater comprising an electric resistance wire coil formed by a substantially helical series of substantially flat convolutions having substantially straight legs and looped ends and with said convolutions each rotated slightly with respect to each preceding convolution throughout the coil length, said coil having an open coil center, a tube having a refractory electrically insulating inside enclosing said coil, said convolutions being held individually spaced from each other free from electrical intercontact by their said looped ends being partially embedded in the inside of said tube so as to lock each convolution against any movement and leave said legs freely exposed inside of said tube, and means for passing and electric heating current through said coil so that fluid flowed through said tube is heated via said convolutions, the latter in the coil's axial direction forming a maze of transversely extending wire sections formed by said legs and surrounding said open coil center.

* * * * *